United States Patent [19]

Grassick

[11] Patent Number: 4,914,756

[45] Date of Patent: Apr. 10, 1990

[54] ARTICLE OF CLOTHING FOR THE HANDICAPPED

[76] Inventor: Betty Grassick, 19279 Arrowhead La., North Ft. Myers, Fla. 33903

[21] Appl. No.: 305,776

[22] Filed: Feb. 3, 1989

[51] Int. Cl.[4] ..... A41D 1/06

[52] U.S. Cl. ..... 2/227; 2/238; 2/DIG. 6; 2/DIG. 7

[58] Field of Search ..... 2/227, 228, 235, 238, 2/DIG. 7, 114, 67, DIG. 6

[56] References Cited

U.S. PATENT DOCUMENTS

| | | | |
|---|---|---|---|
| 3,344,438 | 10/1967 | Title | 2/402 |
| 3,490,072 | 1/1970 | Keltner | 2/114 |
| 4,370,757 | 2/1983 | Richmond | 2/114 X |
| 4,638,509 | 1/1987 | Charron | 2/227 X |
| 4,644,589 | 2/1987 | Pettis | 2/DIG. 7 |
| 4,675,918 | 6/1987 | O'Brien | 2/402 |

FOREIGN PATENT DOCUMENTS

| | | | |
|---|---|---|---|
| 1374231 | 8/1964 | France | 2/232 A |
| 364249 | 1/1932 | United Kingdom | 2/227 |

*Primary Examiner*—H. Hampton Hunter
*Attorney, Agent, or Firm*—Richard C. Litman

[57] ABSTRACT

An article of clothing which can be readily self-donned or put on wearers, such as handicapped persons, by another person, without the necessity of executing normal dressing movements. The article is a single piece of fabric cut so as to wrap about the waist and fasten with pressure-sensitive fastening means to form the outer seams, inseams and crotch area.

6 Claims, 1 Drawing Sheet

ARTICLE OF CLOTHING FOR THE HANDICAPPED

FIELD AND BACKGROUND OF THE INVENTION

The present invention relates in general to clothing articles and, more particularly, to a novel one-piece garment assembly especially suited to persons having physical disabilities or other impairments.

Many people who are permanently or temporarily incapacitated by reason of age, senility, accident or other physical or mental impairments have difficulty in dressing themselves because of restricted movement of their limbs or appendages. Moreover, because of pain or other reasons it is also difficult for others to dress such persons in conventional apparel. For these reasons such people face difficulties each day which contribute to their feeling of helplessness, loss of dignity and inability to cope. This also imposes a burden on those living with handicapped persons and, as will be seen as the present invention is described, an unnecessary burden.

DESCRIPTION OF THE RELATED ART

The prior art illustrates various types of clothing articles, most of which are undergarments, designed for hospital patients and the handicapped.

U.S. Pat. No. 1,130,216 issued to Thayer discloses a knit undergarment comprising a body portion made of fabric having neck and arm openings with shoulder straps in between.

U.S. Pat. No. 3,997,982, issued to Holland, discloses a training vest with a replaceable practice panel to permit handicapped persons to develop manipulative skills.

In U.S. Pat. No. 3,490,072 there is disclosed an examination or hospital gown having selectively positionable blouse panels and skirt flaps to provide the physician access to an area of the body under examination while preventing exposure of regions foreign to such area. The blouse section of the gown is of sleeveless design and the entire gown is separation-free below the arm openings except for side slits defined by the skirt flaps. One side of the gown is closed by a solid stretch of fabric, while the other side is closed by pressure-sensitive fastening means that, when released, communicates the slit at that side with the arm opening thereabove.

McGowan, in U.S. Pat. No. 4,258,440, shows a garment adapted for wear by physically handicapped persons who are incapable of executing normal dressing movements. The garment comprises a front panel applicable to the front of the handicapped person's torso and a rear panel applicable to the back of said person's torso. The front and rear panels each have opposed side edge margins and fastening means distributed thereon for simultaneously assembling and securing the garment to the wearer's torso by interconnecting the front and rear panel along their opposing edge margins in torso-supported relation in the worn condition of the garment, without the necessity of normal dressing movement.

U.S. Pat. No. 4,675,918 relates in general to clothing for the physically disabled comprising a one-piece brief containing an upper band portion with front and rear panels. A short tab portion depends from the center of the front panel while a longer crotch portion descends from the center of the rear panel. Fastening tapes are provided at the edges of the front and rear panels and at the lower edges of the tab and crotch portions. A resilient waistband extends along a top edge of the upper band portion and carries at one end an outwardly-extending fastening tape which engages another fastening tape at an opposite end of the waistband to be used in properly aligning side edges of the front and rear panels.

Pettis in U.S. Pat. No. 4,644,589 discloses a self-donning garment for use of a person with limited movement of arms or legs. The garment in one preferred embodiment comprises a shaped undergarment which has been vertically split along the frontal midline and has a pressure-actuated fastener means applied to the opposed central edges of the split segments. The wearer, laterally in sequence, slips first one arm or leg into one aperture of one segment, then the other one. He then draws the two together along the frontal midline and pressure-fastens the same.

These and other prior art articles of clothing, while useful, are unsatisfactory in one or more respects and none of them, taken singly or in combination, disclose the specific details of the present invention in such a way as to bear upon the claims thereto.

SUMMARY OF THE INVENTION

By the present invention there is provided an improved article of clothing comprising a garment, preferably trousers which, while conventional in appearance, is unconventionally constructed so as to enable ready self-donning thereof by the handicapped person. In general, the invention comprises an article of clothing comprising continuous pieces of fabric cut and attached in such a manner as to wrap about the user at the waist, with the legs and crotch area snugly fitting, and simultaneously fasten with pressure-sensitive fastening means such as VELCRO, a well-known hook-and-loop fastening system, to form a garment.

More specifically, the article comprises in combination a first panel applicable to the front of the wearer's lower body, and a second panel attached to the first, applicable to the lower rear of the body. One edge of the first and second panels has opposed side edge margins and continuous pressure-sensitive fastening means thereon for forming and securing the garment by releasably connecting the said panels along the edge margin in a first trouser or garment-forming configuration. The first and second panels further have an inseam portion extending below the lower body forming a medical crotch section; the inseam portions of each panel have opposed-edge margins and continuous pressuresensitive fastening means thereon for further releasably connecting and simultaneously securing the panels to complete the garment formation. The garment can be self-donned or put on the wearer by another person without need of folding the legs or otherwise executing normal dressing movements.

It is therefore an object of the invention to provide trousers which can be easily donned by the wearer, or put on the wearer by others without need for executing normal dressing movements. The trousers can similarly be readily removed from or by the wearer by reverse actions.

A further object of the invention is to provide a substantially one-piece garment which is simple in design and when put on the wearer, male or female, forms aesthetically pleasing outer garments; slacks, shorts, trousers or pajamas in contrast to the undergarments shown in the prior art.

With these and other objects in view which will more readily appear as the nature of the invention is better understood, the invention consists in the novel construction, combination and assemblies hereinafter more fully illustrated, described and claimed, with reference being made to the accompanying drawings.

BRIEF DESCRIPTION OF THE DRAWINGS

Similar reference characters designate corresponding parts throughout the several figures of the drawings.

DESCRIPTION OF A PREFERRED EMBODIMENT

Figure 1:
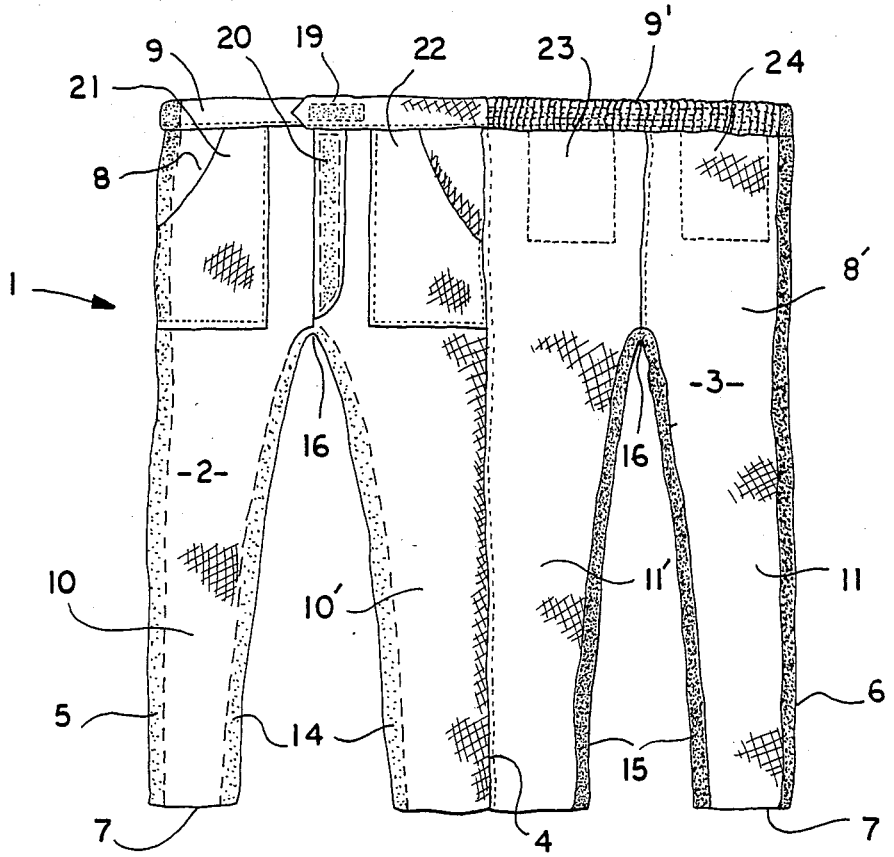
FIG. 1 is a view of the garment of this invention shown in the open configuration prior to assembly as trousers.

Referring to the drawings, FIG. 1 illustrates a substantially one-piece garment of the present invention generally designated 1 comprising a first essentially 2 having a waistband section 9, a hip portion 8 and leg sections 10 and 10' and a second panel 3 having a waistband section 9', a hip portion 8' and leg sections 11 and 11'. First panel 2 is integral with and permanently joined to second panel 3 along seam line 4 which extends vertically along the entire length of an integral edge of each panel to define an outer seam of the garment according to the present invention. Panels 2 and 3 each contain a continuous strip of cooperating fastening material 5 and 6, respectively, consisting of of a pressure-sensitive band permanently affixed vertically along an outer border and extending from the bottom edge 7 of leg sections 10 and 11 to the top of waistband sections 9 and 9'. Strip 5 comprises a mating component of conventional hook-and-loop fasteners adapted to cooperate with strip 6, such that strip may consist of the hook component and strip 6 may consist of the loop component or vice versa, so that when the two strips are allowed to contact each other a releasable connection is made whereby to form outer seam 12 (FIGS. 2 and 3) of the completed garment. The other outer seam 13 is defined by the aforementioned line 4 shown in FIG. 1.

Referring again to FIG. 1, first and second panels 2 and 3 further comprise continuous strips of cooperating fastening material 14 and 15, respectively, each consisting of a mating component of hook-and-loop fasteners permanently affixed along interior borders of leg section 10, 10' and 11, 11',respectively, and defining a medical crotch area 16. Strip 14 may be of the hook component of a hook-and-loop fastener and strip 15 may be of the loop type or vice versa, so that when the two pressure-sensitive strips are contacted a releasable connection is made whereby to form inseams 17 and 18 (FIGS. 2 and 3) and crotch area 16 of the garment in the joined configuration.

Figure 2:
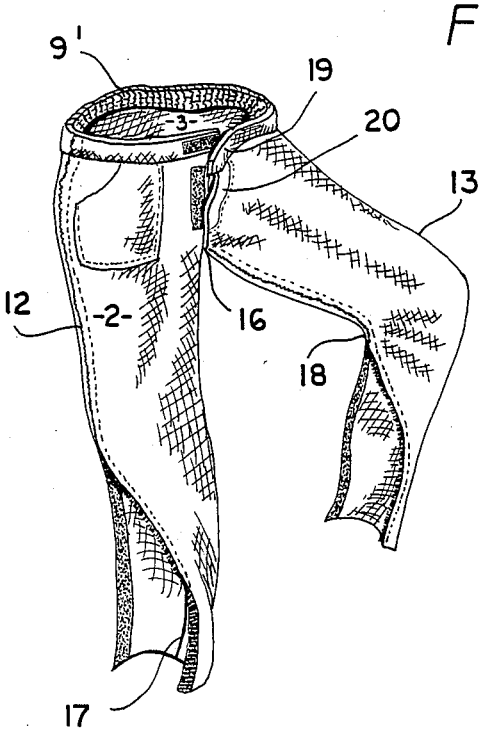
FIG. 2 is a view of the garment of FIG. 1 in a partial trouser formation configuration.

Waistband section 9' is formed preferably of an elastic fabric or other resilient material sized to comfortably accommodate the waist size of the wearer. Alternatively, waistband section 9 may also be formed of elastic fabric or similar material, as well portions of the waistband sections could also be constructed of similar fabric, as desired. In another preferred embodiment, as best depicted in FIG. 2, the garment of the present invention is provided with a tab portion 19, preferably including a fly portion 20, which depends from the approximate center of front panel 2. The tab and fly portions have attached thereto narrow pieces of pressuresensitive fastening means consisting of a mating component of hook-and-loop fasteners to releasably connect the garment about the wearer's waist and to provide access to the wearer's genital area. It is readily apparent that the fly portion 20 could be omitted in garments designed for females, for example.

The trousers shown in FIG. 1 preferably contain pockets 21 and 22 in front panel 2 and rear pockets 23 and 24 in rear panel 3, all of which have conventional uses. Pockets 21 and 22 are disposed at hip portion 8 of frontal panel 2 and may be fabricated in a variety of styles to simulate fashionable apparel. The number of pockets may vary considerably or may be eliminated entirely example, there would appear to be no need for pockets in garments designed for use as pajamas.

Figure 3:
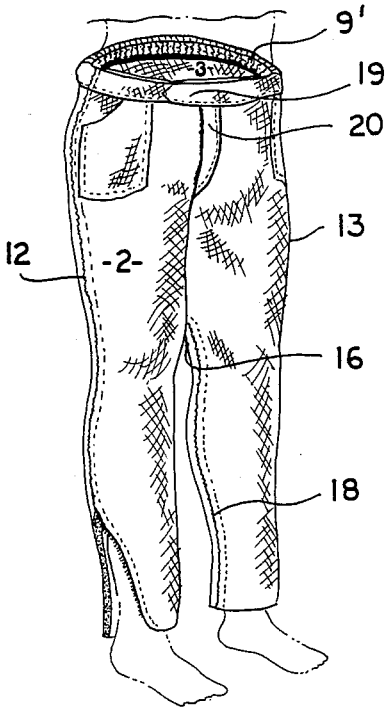
FIG. 3 is a view of the garment of FIG. 1 in a complete trouser formation configuration except for the unjoined bottom right leg.

To don the garment, the rear panel 3 is applied to the lower rear of the wearer's body and front panel 2 wrapped across the front of the wearer's lower body and panels 2 and 3 are attached about the waist by connecting waistband sections 9 and 9' with cooperating pressure-sensitive fastening material affixed thereon. Continuous strips 5 and 6 on the outer edges of the panels are properly aligned and then joined by contacting and compressing the attached cooperating mating components of the hook-and-loop fastener to form outer seam 12 (FIGS. 2 and 3). To complete donning of the depicted trousers cooperating strips 14,15 are aligned and joined by contacting and compressing their respective mating components of the hook-and-loop fastener to form inseams 17,18 and crotch area 16 shown, for example, in FIG. 3. The other outer seam 13 (FIGS. 2,3) automatically forms along seam line 4 (FIG. 1). Variations is the size of the waistband of the trousers can be made by slight adjustments at tab 19 to provide a garment in accordance with the present invention which can worn with comfort and dignity by the physically impaired wearer.

Although the garment shown in the drawings attaches on the right side of the wearer to form outer seam 12, it is obvious that panels 2 and 3 could be reversed whereby said outer seam would be on the left.

While I have illustrated and described the preferred form of construction for carrying the invention into effect, this is capable of variation and modification without departing from the spirit of the invention. I therefore do not wish to be limited to the precise details of construction as set forth, but desire to avail myself of such modifications and variations as come within the scope of the appended claims.

I claim:

1. A one-piece garment adaptable for self-donning and for donning by another onto a wearer having difficulty executing normal dressing movements comprising, in combination:

a first panel having a waistband section, a hip portion and leg sections applicable to the front of a wearer's lower body;

a second panel having a waistband section, a hip portion and leg sections applicable to the rear of the wearer's lower body;

said first panel being integral with and permanently joined to said second panel by a seam extending vertically along the entire length of an integral edge of the panels to define an outer seam of the garment;

a continuous strip of cooperating fastening material permanently affixed vertically along the entire length of an outer border of each of said first and second panels for releasably connecting corresponding sections of the panels to form an opposite outer seam of the garment; and a continuous strip of cooperating fastening material permanently affixed along interior borders of said leg sections of each of said first and second panels for releasably joining corresponding sections of the panels to form leg inseams and a crotch area of the garment in a completed configuration.

2. The garment according to claim 1 wherein said continuous strip of cooperating fastening material comprises a mating component of a hook-and-loop fastener.

3. The garment according to claim 1 wherein said waistband section of said first panel includes a tab and a fly portion depending from the approximate center of the first panel.

4. The garment according to claim 1 wherein said waistband section of said second panel comprises an elastic fabric material.

5. The garment according to claim 1 wherein said garment in the completed configuration consists of trousers.

6. The garment according to claim 1 wherein said first panel and said second panel include a plurality of pockets disposed laterally along said hip section.

* * * * *